US006198456B1

(12) United States Patent
Le Halle et al.

(10) Patent No.: US 6,198,456 B1
(45) Date of Patent: Mar. 6, 2001

(54) INTEGRATED TRANSMITTER OR RECEIVER DEVICE

(75) Inventors: Corinne Le Halle, Chaville; Yves Canal, Antony; Emile Pouderous, Boulogne, all of (FR)

(73) Assignee: Thomson-CSF, Paris (FR)

( * ) Notice: Subject to any disclaimer, the term of this patent is extended or adjusted under 35 U.S.C. 154(b) by 0 days.

(21) Appl. No.: 09/147,688

(22) PCT Filed: Jun. 9, 1998

(86) PCT No.: PCT/FR98/01176

§ 371 Date: Feb. 16, 1999

§ 102(e) Date: Feb. 16, 1999

(87) PCT Pub. No.: WO98/57391

PCT Pub. Date: Dec. 17, 1998

(30) Foreign Application Priority Data

Jun. 13, 1997 (FR) ..... 97 07353

(51) Int. Cl.[7] ..... H01Q 13/00

(52) U.S. Cl. ..... 343/786; 343/774; 343/776

(58) Field of Search ..... 343/772, 74, 776, 343/786, 700 MS; H01Q 13/00

(56) References Cited

U.S. PATENT DOCUMENTS

| | | | | |
|---|---|---|---|---|
| 4,408,208 | * | 10/1983 | Dumas | 343/786 |
| 4,527,165 | * | 7/1985 | De Ronde | 343/786 |
| 4,591,865 | | 5/1986 | Canal | 343/767 |
| 4,743,918 | | 5/1988 | Rannou et al. | 343/895 |
| 4,888,597 | * | 12/1989 | Rebiez et al. | 343/778 |
| 5,191,346 | | 3/1993 | Avignon et al. | 342/61 |
| 5,266,956 | | 11/1993 | Canal et al. | 342/128 |
| 5,332,998 | | 7/1994 | Avignon et al. | 342/64 |
| 5,349,358 | | 9/1994 | Canal | 342/128 |
| 5,446,470 | | 8/1995 | Avignon et al. | 343/713 |
| 5,534,870 | | 7/1996 | Avignon et al. | 342/70 |
| 5,563,589 | | 10/1996 | Blaimont et al. | 340/933 |
| 6,064,350 | * | 5/2000 | Uchimura et al. | 343/786 |

* cited by examiner

*Primary Examiner*—Hoanganh Le
*Assistant Examiner*—Hoang Nguyen
(74) *Attorney, Agent, or Firm*—Oblon, Spivak, McClelland, Maier & Neustadt, P.C.

(57) ABSTRACT

The present invention relates to a transmission or reception device. The device comprises several layers having openings such that the stack thereof produces one or more antennas. Microwave circuits are implanted on internal layers.

18 Claims, 4 Drawing Sheets

INTEGRATED TRANSMITTER OR RECEIVER DEVICE

BACKGROUND OF INVENTION

1. Field of the Invention

The present invention relates to an integrated transmission and/or reception device. It applies for example in the production of broadband integrated sensors.

2. Discussion of the Background

An integrated sensor is generally formed of several independent elements linked by conventional means of connection. These elements consist for example of one or more plane antennas, of a circuit comprising the microwave functions together with its own mechanical casing, of a coaxial strap between the antenna and the aforementioned casing and of an analogue control card linked to this casing by connections using wires or pads. With the aim of producing a compact and highly integrated sensor, the antenna consists of a plane radiating element, generally termed a "ipatch". The environmental constraints are catered for and mechanical cohesion is achieved via several independent casings. The casing comprising the microwave functions comprises several ceramics linked together by strips or gold-plated wires. At high operating frequencies, of the order of one to several tens of Gigahertz for example, very small differences in the dimensions may introduce considerable phase differences between the pathways. Accordingly, the ceramics which are manufactured independently of one another exhibit physical scatter requiring tuning of the various reception pathways, this tuning being carried out with regard to the phase and amplitude differences created between the pathways, assumed to be identical.

Other drawbacks are due to the current embodiment of the sensors. In particular, the cables, of which there is a large number, prevent the sensor from operating in sub-bands. Sub-band operation uses several types of antennas each assigned a sub-band, and thus each antenna is perfectly matched to the signals received, thus making it possible in particular to improve the sensitivity of detection of these received signals. Moreover, the noise is reduced on account of the decrease in the bandwidths involved.

It should additionally be noted that the lengthening of the electrical lengths gives rise to ripples and hence, here again, a drop in sensitivity with regard to the signals received.

SUMMARY OF THE INVENTION

The object of the invention is in particular to alleviate the aforementioned drawbacks by means of a compact construction which is developed in three dimensions. To this end, the subject of the invention is a transmission or reception device, characterized in that it comprises several layers having openings such that the stack thereof produces one or more antennas.

The main advantages of the invention are in particular that it allows a simplification of mechanical structure, that it allows a simplification of the processing of the information supplies, that it allows upgrades and simple repairs a that it is economical.

BRIEF DESCRIPTION OF THE DRAWING

Other characteristics and advantages of the invention will become apparent with the aid of the description which follows given in conjunction with the appended drawings, which represent.

DETAILED DESCRIPTION OF THE PREFERRED EMBODIMENTS

Figure 1:
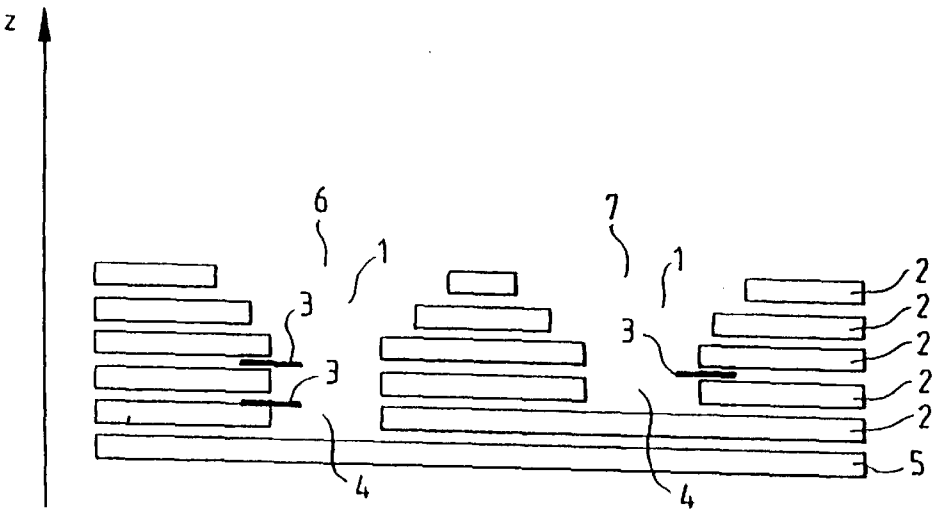
FIG. 1, the principle of construction of a device according to the invention.

FIG. 1 illustrates the principle of construction of a device according to the invention. To obtain in particular a compact device, use is made of volume antennas, of the horn type 1, rather than antennas with plane radiating elements. These horn antennas are formed by assembling the microwave circuits and stacking their mechanical supports 2 along an axis z perpendicular to their plane, the horn antennas being nested in these microwave circuits. This stacking also produces the guides (4) for closing these horns and for guiding the microwave signals. As well as allowing the construction of a compact and integrated device, the invention therefore makes it possible to use antennas of sizeable volume, and consequently to obtain good efficiency. Additionally, the disappearance of the connections between casings makes it possible to split the signal into relatively narrow sub-bands, for which horn antennas are particularly well suited, especially in respect of reception. The manufacture of the antennas does not give rise to any on-cost since they are constructed by assembling the mechanical supports 2.

Figure 2:
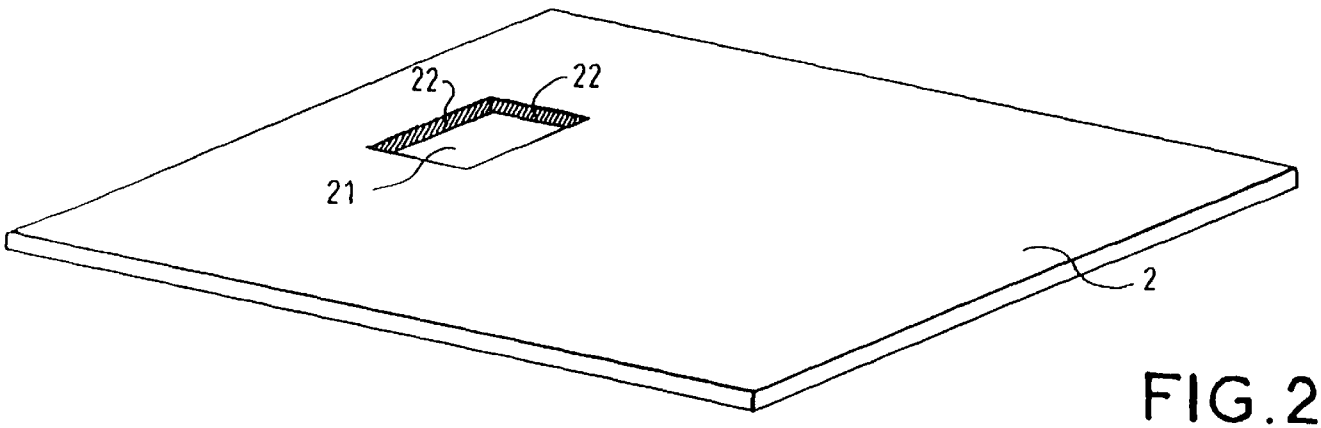
FIG. 2, an example of an opening in a constituent layer of a device according to the invention.

In order to optimize the links between the microwave circuits and the antennas, these circuits are preferably supported by internal constituent layers 2 of the antennas. However, not all the mechanical supports 2 contain microwave circuits or microwave elements of circuits. The supports 2 are for example printed circuits or pure metal plates, if they are in printed circuit form; their edges which constitute wall parts of the horns or of the waveguides are for example metallized as illustrated in FIG. 2. This shows a printed circuit 2, which supports for example microwave functions which are not shown. This printed circuit has a hole or a drilling 21 which constitutes part of a guide or horn and whose edges 22 are metallized. A mechanical support 2 which does or does not support a circuit constitutes a layer of the device according to the invention. The layers 2 do not necessarily have the same thickness, the latter depends in particular on the functions or on the circuits making up the layer, or else on the materials used.

The stacking of layers 2 which are open in the microwave sense, drilled or non-drilled, to produce the horns 1 and the associated waveguides 4 constituting the antennas, must ensure the electrical continuity of the walls of the horns and of the guides, for example by virtue of a metallization of the edges 22 of the drilled layers or by virtue of the metallized holes suitably distributed in respect of the non-drilled layers, continuity being obtained in this case for example by direct contact between the layers or by interposing cables or conductive shims.

A microwave signal is picked up or transmitted by one or more plungers 3, for example etched onto the supports 2 which overhang into the waveguides 4 leading to the horns 1. These guides 4 are formed in the same way as the horns 1, that is to say by stacking the mechanical supports. They can also be nested in the microwave circuits. The mechanical supports 2 being drilled for this purpose. The drillings performed correspond to transverse sections of the horns and of the guides. A support or layer 5 closes a waveguide. This support 5 is for example a printed circuit, a surface of which is metallized facing the guides 4. These guides can have different depths, stated otherwise it is not the same support which closes or short-circuits all the waveguides.

Figure 3:
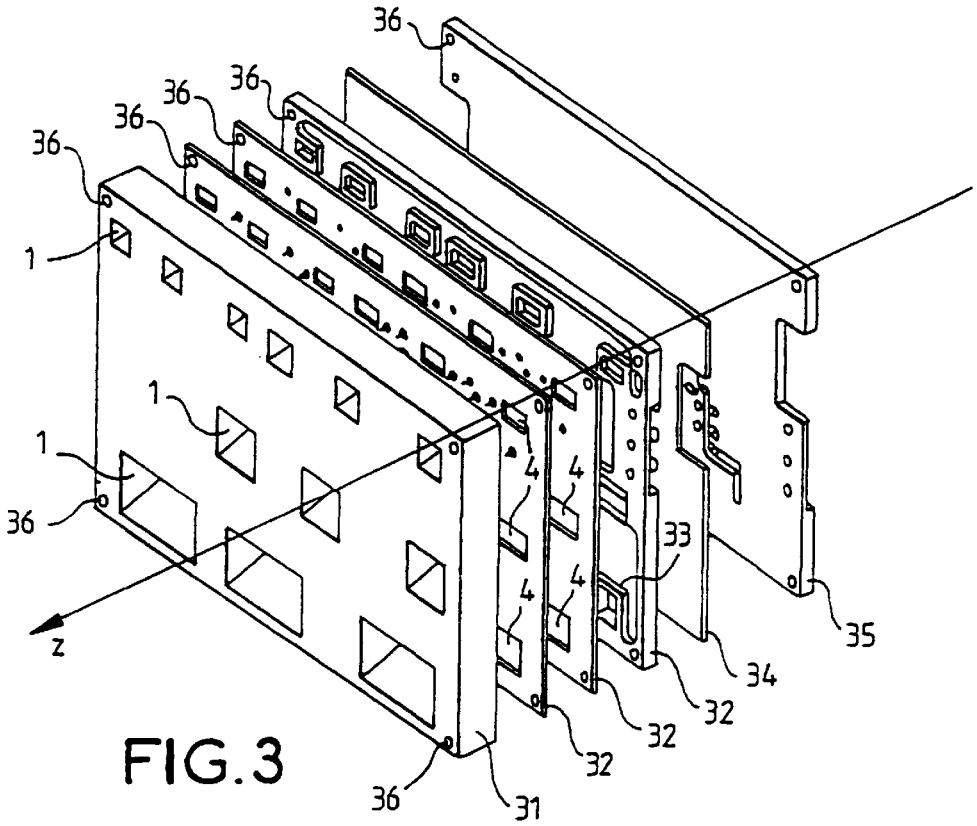
FIG. 3, in an exploded view, an illustrative embodiment of a device according to the invention.

FIG. 3 shows in a perspective exploded view an illustrative embodiment of a device according to the invention. The view is exploded along the aforementioned z axis. A first support 31 comprises the horns 1 of the various antennas. This first support may for example be monobloc, made of metal. It may also for example consist of several layers or printed circuits which do or do not contain microwave functions. Other mechanical supports 32 form, by being stacked for example, the waveguides 4. These mechanical supports are for example printed circuits and comprise for example microwave functions 33. Last supports 34, 35 close, for example, the waveguides 4 whilst comprising electronic circuits.

In the illustrative implementation of FIG. 3, the device according to the invention operates according to three frequency sub-bands, the set of sub-bands constituting the total operating band. To this end, it comprises three types of antennas, and hence in particular three series of horns 1. One type of antenna is matched to a given sub-band. It is defined by the section of the horns 1 and of the guides 4, as well as by their depth. FIG. 1 thus shows a cross section through two antennas 6, 7 matched to two different sub-bands.

Since the antennas are constructed by stacking the various layers 2, 31, 32, 34, 35, the information is for example picked up therefrom by the plungers 3 etched onto substrates which constitute the whole or parts of the stacked mechanical supports, these substrates moreover supporting microwave functions. A layer serves for example to transmit a test or calibration signal; the signal transmitted by a plunger 3 from a low layer is for example picked up by the reception circuits implanted on a higher-level layer, the height level being taken in the direction of the said axis, directed from the bottom of the guides towards the opening of the horns. A horn 1 terminates in a waveguide 4 which passes through several layers 2 of circuits and it can be connected to each circuit by a plunger 3 linked to the latter. The high-frequency information can then be picked up and processed by the higher layers, thus shortening the route of the signals and hence the losses, the signals undergoing a frequency transposition as close as possible to the antennas.

A layer 2 can consist for example of a single substrate. For applications which require identical reception pathways, it is then possible to group all these pathways together onto one and the same layer, thereby limiting the scatter between pathways. Thus, in the case in which the chopping of the useful band into sub-bands must be effected without the appearance of phase differences between the pathways, each layer is composed of a single printed circuit which groups together the same functions of the various pathways. The scatter due to the differences in manufacturing procedure is decreased. This possibility of arranging the functions of like nature on one and the same layer 2 for all the pathways is applicable to the other electronic functions of reception, transmission, processing, control, power-supply or interface channels. Moreover, a device according to the invention can be easily upgraded insofar as each layer can contain an independent electronic or microwave function. For this same reason, such a device can easily be repaired.

The passing of the microwave signals between layers is for example ensured by coaxial transitions soldered to the inlet or outlet tracks. As far as the low-frequency signals are concerned, they may be enabled to pass between layers along the z axis using the known techniques of multi-layer printed circuits.

The invention dispenses with all the wire connections between the various sub-assemblies such as the antennas, and the analogue or digital functions. The reflections and losses due to passages between the cables and the casings disappear. The system therefore becomes more sensitive and requires fewer amplifiers, these being expensive elements in microwave circuits. This results moreover in a reduction in noise. Finally, all this simplifies the processing of the information. The reduction in the microwave amplifiers gives rise moreover to a reduction in the problems of thermal conditioning by virtue of less dissipation.

Tapped holes 36 are for example provided, for example at the corners of each layers 2, 31, 32, 34, 35, the latter having in particular a rectangular surface. The layers can then be fixed together by screws passing through the complete stack. The layers can also be fixed together by adhesive bonding or soldering, although the stack can no longer be easily dismantled and hence repairs or intervention on buried tracks, or else on buried components such as those illustrated by the following figure are more complicated or made impossible.

Figure 4:
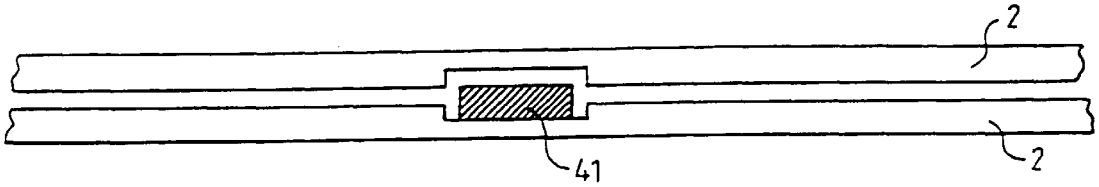
FIG. 4, an illustrative embodiment according to the invention, comprising a buried component.

FIG. 4 shows a partial illustrative embodiment which makes it possible to gain even more in terms of compactness and integration. A component 41 is buried between two layers 2. To this end, at least one of the two layers is hollowed out so as to house the component. The component 41 is for example a surface-mounted component which has the advantage in particular of being easily mounted on a printed circuit. Thus, the use of components in chip form is avoided, the wiring and conditioning of which are expensive. The use of surface-mounted components is possible in particular by virtue of sub-band operation which enables these components to operate in narrow bands.

Figure 5:
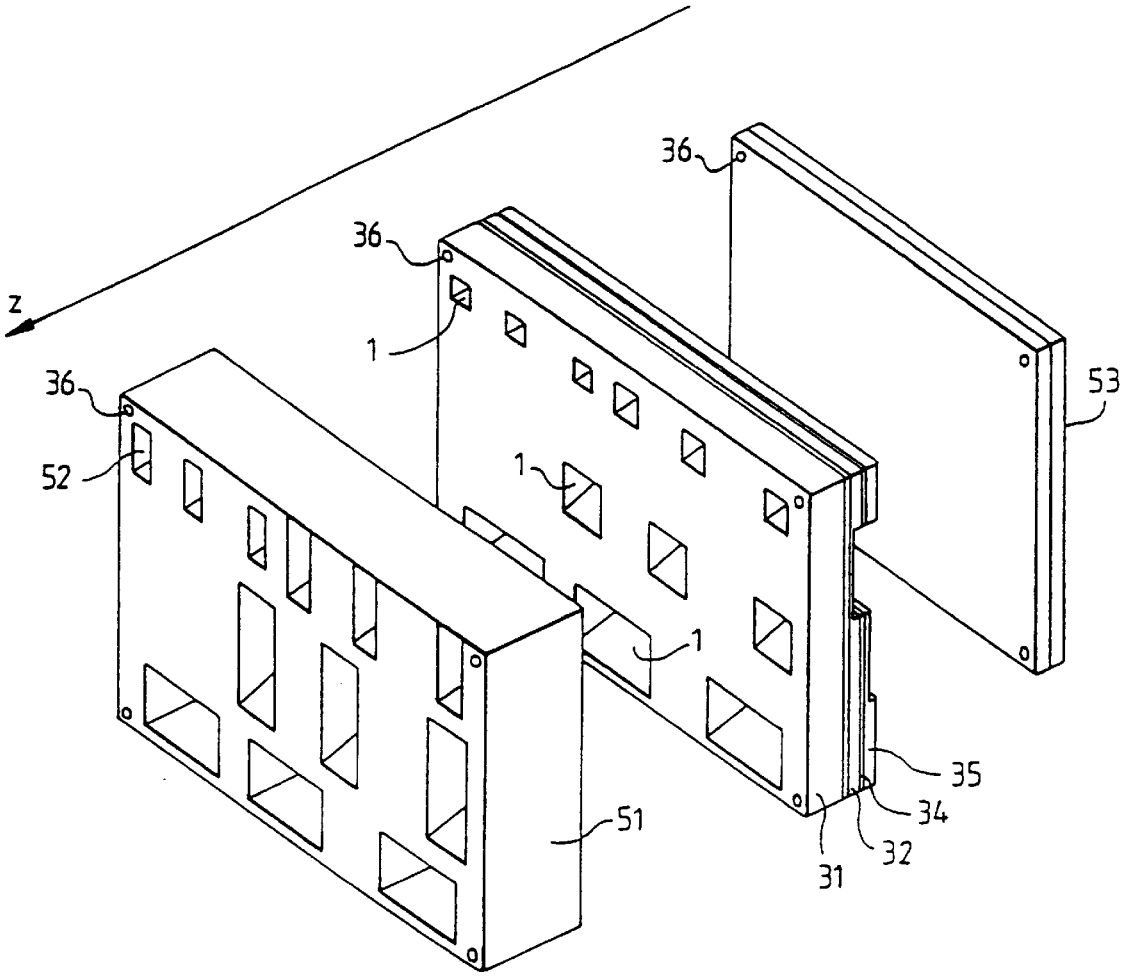
FIG. 5, an illustrative embodiment according to the invention, comprising an additional upper layer for increasing the antenna gains or an additional lower layer for control and digital processing.

FIG. 5 illustrates other possible illustrative embodiments of a transmission or reception device according to the invention, via a view exploded along the z axis. The layers 31, 32, 34, 35 represented in the exploded view in FIG. 3 are grouped together here. An additional upper layer 51 is placed in front of the horns 1 so as to increase the gain of the antennas. To this end, the additional layer comprises openings 52 arranged facing the horns 1 of the first layer 31. The additional layer is for example made as a single metal block. At least one additional layer 53, for example a lower layer, is for example also provided. This layer comprises in particular digital functions and low-frequency analogue functions. These functions comprise for example analogue/digital conversion means for digitally converting the signals picked up. A processor makes it possible for example to interpret or to shape the signals thus converted so that the transmission or reception device is able directly to deliver a numerical datum representative of the signals picked up. These data can be taken into account by any means of reading or processing by means, for example, of conventional interfaces. The additional layer 53 also contains for example digital functions intended to provide transmission or reception controls.

Figure 6A:
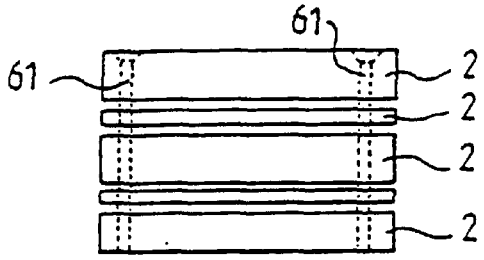
FIGS. 6*a*, 6*b* and 6*c*, respectively, one non-hermetic illustrative embodiment and two hermetic illustrative embodiments.

The invention makes it possible to obtain a simplified mechanical structure since the latter consists mainly of the stack of layers. There is a simplification of the mechanical protection since, once joined, the layers form a box which replaces the numerous boxes of current solutions. The structure thus formed as illustrated for example by FIG. 6*a* is not, however, hermetic. If need be, it can be made hermetic according to illustrative embodiments such as those illustrated by FIGS. 6*b* and 6*c*.

Figure 6B:
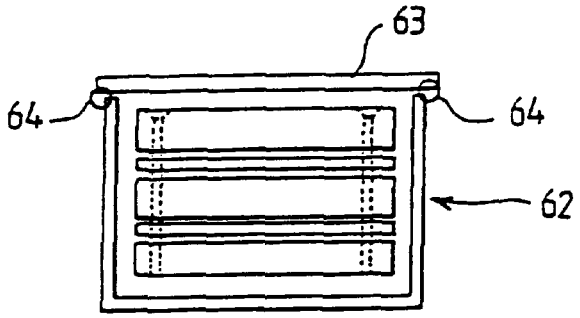
Figure 6C:
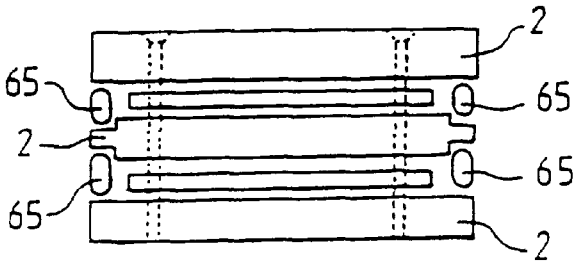

FIG. 6*a* represents a non-hermetic stack of layers 2, the assembly being fixed for example by screws 61 passing through the layers. Certain circuits, comprising in particular tracks and microwave components, need to be insulated from the exterior environment for reasons of mechanical strength or life time for example. FIG. 6*b* depicts a first example of hermetic insulation. The set of layers is enclosed within a casing 62 topped off by a cover 63 possessing dielectric windows which make it possible to allow the microwaves through; these windows are arranged facing the antenna openings 1, 52. A shim 64 ensures perfect sealing between the casing and the cover. The cover 63 is made for example entirely of dielectric material. FIG. 6*c* depicts another example of hermetic insulation. To this end, one out of every two layers 2 is enlarged so as to interpose a shim 65, clamped between the ends of the enlarged layers.

From the foregoing description it is therefore apparent that the invention makes it possible to eliminate or greatly decrease the connections between the antennas and the microwave circuits and between the other functions. It is moreover apparent that it makes maximum use of the volumes and surfaces which are not occupied by the horn antennas, by integrating the antennas into the thickness of the stack of circuits and the use of the same layer as participates in the antenna and supports the electronic functions.

What is claimed is:

1. Transmission or reception device comprising:

a plurality of layers having openings and being stacked such that the openings form at least one horn and at least one waveguide which is in communication with the at least one horn, the at least one waveguide being configured to close the at least one horn and to guide microwave signals, at least one of the plurality of layers including microwave and electronic functions; and plungers etched onto the plurality of layers overhang into the at least one waveguide.

2. Device according to claim 1, characterized in that the waveguide guiding a microwave signal to the horn, one of the layers closes the waveguide.

3. Device according to claim 2, characterized in that is comprises several types of antennas so as to operate in sub-bands.

4. Device according to claim 1, characterized in that the device comprises several types of antennas so as to operate in sub-bands.

5. Device according to claim 1, characterized in that all the reception or transmission pathways are implanted on one and the same layer.

6. Device according to claim 1, characterized in that tapped holes are made in the layers, the latter being fixed together by screws.

7. Device according to claim 1, characterized in that at least one component is buried between two layers, at least one of the two layers being hollowed out so as to house the component.

8. Device according to claim 1, characterized in that edges of layers overlooking antennas are metallized.

9. Device according to claim 1, characterized in that the layers comprise metallized holes for ensuring electrical continuity.

10. Device according to claim 1, characterized in that a waveguide guiding a microwave signal to the horn, a layer closes the guide.

11. Device according to claim 1, characterized in that is comprises several types of antennas so as to operate in sub-bands.

12. Transmission or reception device comprising:

a plurality of layers having openings and being stacked such that the openings form at least one horn and at least one waveguide, the at least one waveguide being configured to close the at least one horn and to guide microwave signals, at least one of the plurality of layers including microwave and electronic functions, one out of every two of the plurality of layers being enlarged; and at least one shim clamped between ends of the enlarged layers.

13. Transmission or reception device comprising:

a plurality of layers having openings and being stacked such that the openings form at least one horn and at least one waveguide which is in communication with the at least one horn, the at least one waveguide being configured to close the at least one horn and to guide microwave signals, at least one of the plurality of layers including microwave and electronic functions, wherein a signal is transmitted by a plunger from a low layer near a bottom of the at least one waveguide and is picked up by reception circuits implanted on a higher-level layer stacked further from the bottom, the level of the layer increasing from the bottom of the waveguide toward an opening of the horn.

14. Transmission or reception device comprising:

a plurality of layers having openings and being stacked such that the openings form at least one horn and at least one waveguide which is in communication with the at least one horn, the at least one waveguide being configured to close the at least one horn and to guide microwave signals, each of the plurality of layers including an independent electronic or microwave function.

15. Transmission or reception device comprising:

a plurality of layers having openings and being stacked such that the openings form at least one horn and at least one waveguide which is in communication with the at least one horn, the at least one waveguide being configured to close the at least one horn and to guide microwave signals, at least one of the plurality of layers including microwave and electronic functions; and an additional upper layer having openings extending antennas so as to increase their gain.

16. Transmission or reception device comprising:

a plurality of layers having openings and being stacked such that the openings form at least one horn and at least one waveguide which is in communication with the at least one horn, the at least one waveguide being configured to close the at least one horn and to guide microwave signals, at least one of the plurality of layers including microwave and electronic functions; and a layer on which low-frequency analogue circuits and digital circuits for processing signals received are provided.

17. Transmission or reception device comprising:

a plurality of layers having openings and being stacked such that the openings form at least one horn and at least one waveguide which is in communication with the at least one horn, the at least one waveguide being configured to close the at least one horn and to guide microwave signals, at least one of the plurality of layers including microwave and electronic functions; and a layer on which digital circuits for controlling transmission or reception are provided.

18. Transmission or reception device comprising:

a plurality of layers having openings and being stacked such that the openings form at least one horn and at least one waveguide which is in communication with the at least one horn, the at least one waveguide being configured to close the at least one horn and to guide microwave signals, at least one of the plurality of layers including microwave and electronic functions;

a casing which contains the plurality of layers; and a cover which closes the casing and which has dielectric windows facing the at least one horn.

* * * * *